United States Patent [19]

Josso et al.

[11] Patent Number: 4,844,739

[45] Date of Patent: Jul. 4, 1989

[54] HYDRAZINE BATH FOR CHEMICALLY DEPOSITING NICKEL AND/OR COBALT, AND A METHOD OF PREPARING SUCH A BATH

[75] Inventors: Pierre J. Josso, Issy les Moulineaux; Isabelle V. Gossart, Chatenay Malabry; Claude Duret-Thual, Rive de Gier, all of France

[73] Assignee: Office National d'Etudes et de Recherches Aerospatiales, Chatillon Sous Bagneux, France

[21] Appl. No.: 932,639

[22] Filed: Nov. 19, 1986

[30] Foreign Application Priority Data

Nov. 22, 1985 [FR] France ..... 85 17339

[51] Int. Cl.[4] ..... C23C 18/36

[52] U.S. Cl. ..... 106/1.27; 106/1.22; 427/438; 427/443.1

[58] Field of Search ..... 106/1.22, 1.27; 427/443.1, 431, 437, 438, 436; 556/138

[56] References Cited

U.S. PATENT DOCUMENTS

| | | | |
|---|---|---|---|
| 3,416,955 | 12/1968 | Makowski et al. | 106/1.27 |
| 4,265,943 | 5/1981 | Goldstein et al. | 106/1.27 |
| 4,368,223 | 1/1983 | Kobayashi et al. | 106/1.27 |
| 4,371,573 | 2/1983 | Januschkowetz | 106/1.22 |
| 4,636,255 | 1/1987 | Tsuda et al. | 106/1.22 |

OTHER PUBLICATIONS

Plating, vol. 54, No. 4, Apr. 1967, pp. 385–390, Dini et al., "Thick Nickel Deposits of High Purity by Electroless Methods".

Search Report for French Priority Application 85 17 339, Listing the Three Above Prior-Art Publications.

*Primary Examiner*—Josephine Barr

*Attorney, Agent, or Firm*—Herbert Dubno; Jonathan Myers

[57] ABSTRACT

The bath uses nickel-II-tri(ethylenediamine) hydroxide and/or cobalt-II-tri(ethylenediamine) hydroxide having the formula $M(NH_2—C_2H_4—NH_2)_3(OH)_2$ as a source of the metal to be deposited, where M represents nickel and/or cobalt, and where the ethylenediamine acts as the complexing agent.

13 Claims, No Drawings

HYDRAZINE BATH FOR CHEMICALLY DEPOSITING NICKEL AND/OR COBALT, AND A METHOD OF PREPARING SUCH A BATH

The invention relates to chemically depositing nickel and/or cobalt by autocatalytic reduction.

BACKGROUND OF THE INVENTION

All the baths previously used industrially for this type of deposition, and regardless of whether they are acid baths or alkaline baths, make use of a reducing agent containing phosphorous or boron in the form of an alkaline hylpophosphite or hydrogenated derivatives of boron. In addition to the reducing agent, they contain at least one compound of the metal(s) to be deposited, at least one complexing agent for said metal, and at least one stabilizing agent.

The deposits of nickel and/or cobalt obtained from such baths are not pure. They contain phosphorous or boron from the reducing agent together with elements from the stabilizing agents: sulfur and/or heavy metals, e.g. thallium.

ONERA's published French patent application No. 2 531 103 describes baths for obtaining deposits which are free from impurities coming from the stabilizing agents, and which are intended, in particular, for treating turbine blades for aeronautical applications where such impurities are highly undesirable and cannot be removed by subsequent treatments.

However, the deposits obtained still contain phosphorous or boron from the phosphorous or boron reducing agents and these impurities are also unwanted in the applications concerned; they must therefore be removed after deposition.

Unfortunately, it is very difficult (and even impossible in some cases) to eliminate phosphorus. And although boron can be removed, for example by the method described in ONERA's published French patent application No. 2 278 794, such removal is not complete.

There thus exists a need for chemical deposition baths in which the reducing agent contains neither phosphorous nor boron so as to avoid said impurities being present in the deposit.

Hydrazine satisfies these conditions: when oxidized by ions of nickel or cobalt it gives rise solely to hydrogen and nitrogen, both of which escape in the gaseous state.

Baths for chemically depositing nickel and/or cobalt and including hydrazine as a reducing agent are described in an article by Dini and Coro published in "Plating" vol. 54, p. 385 (1967), and in U.S. Pat. No. 3,198,659.

The baths described in the article require the use of very high purity starting products, and maintaining such baths is extremely difficult, so they are too expensive to be used to develop the method on an industrial scale.

The baths described in U.S. Pat. No. 3,198,659 are capable solely of providing very thin deposites as mentioned in the article which refers to said patent, with the deposit thickness being about one micron.

An aim of the invention is to provide baths capable of chemically depositing nickel and/or cobalt on an industrial scale and also to enable very pure deposits of oonsiderable thickness to be obtained.

Another aim of the invention is to provide hydrazine baths capable of chemically depositing nickel and/or cobalt on an industrial scale and of giving rise to deposits of considerable thickness.

In order to solve this problem, the inventors have studied the equilibria and the chemical reactions which obtain in hydrazine baths, and as a result of this work they have formulated the following hypotheses.

The nickel and/or cobalt ions are complexed concurrently both by the hydrazine and by the complexing agent per se in the bath, with the fractions complexed by the hydrazine and by the complexing agent being determined by the dissociation constants of the two complexing reactions.

The nickel and/or cobalt is deposited solely by discharge from the hydrazine/metal cation complex.

Numerous ions, and in particular chloride, sulfate and nitrate ions, have a disturbing effect on the formation of the hydrazine/metal cation complex and/or on the catalytic activity of the deposit.

These considerations have pointed the inventors on the path to a solution.

The present invention provides a bath for chemically depositing nickel and/or cobalt, the bath comprising a compound of the metal(s) to be deposited, a reducing agent, at least one complexing agent for the metal, and at least one stabilizing agent.

SUMMARY OF THE INVENTION

According to a first aspect of the invention, the bath is selected so that the anions which it contains or which are produced therein in use are almost exclusively hydroxyl ions.

According to another aspect of the invention the said compound, the said reducing agent, and the said complexing agent are such that their anions are essentially hydroxyl ions, as are the anions produced when the bath is used.

The presence of anions likely to have an unwanted effect on the reducing action and/or on the catalytic activity of the deposit is thus eliminated, or at least substantially eliminated.

In a preferred embodiment, using hydrazine as the reducing agent, the said compound is nickel-II-tri(ethylenediamine) hydroxide and/or cobalt-II-tri(ethylenediamine) hydroxide having the formula $M(NH_2—C_2H_4—NH_2)_3(OH)_2$ where M represents nickel and/or cobalt, and the ethylenediamine acts as the complexing agent.

According to another aspect, the invention provides a bath for chemically depositing nickel and/or cobalt, the bath comprising a compound of the metal(s) to be deposited, a reducing agent constituted by hydrazine, a complexing agent for the metal, and at least one stabilizing agent. wherein said compound is nickel-II-tri(ethylenediamine) hydroxide and/or cobalt-II-tri(ethylenediamine) hydroxide having the formula M ($N_2$13 $C_2H_4NH_2)_3(OH)_2$ where M represents nickel and/or cobalt, and the ethylenediamine acts as the complexing agent.

The nickel- (or cobalt-) II-tri(ethylenediamine) hydroxide is quite compatible with hydrazine, and by using them together it is possibIe for the bath to continue operating for a practically unlimited length of time so long as metal compound and reducing agent are added continuously, with the concentration of ethylenediamine having no effect on the depositing mechanism so long as there is excess ethylenediamine, and as a result it is possible to obtain deposits which are very pure and thick.

The bath in accordance with the invention is preferably raised to a pH which is greater than 11 by means of an alkalinizing agent which may be sodium hydroxide.

A bath in accordance with the invention allows particles such as alumina $Al_2O_3$ or yttria $Y_2O_3$ contained in the bath to be included in the deposit. Since the characteristics of the bath do not vary significantly with time, the particles are uniformaly distributed through the thickness of the deposit.

The invention also provides a method of preparing a bath as described above, in which an alkaline solution of $M(NH_2—C_2H_4-NH_2)_3(OH)_2$ known as the "mother" solution is prepared and the stabilizing agents and the hydrazine are subsequently added thereto.

Such a mother solution is perfectly stable and can be used to prepare baths suitable for various different applications by adding appropriate stabilizing agents and, optionally, particles.

BRIEF DESCRIPTION OF THE FIGURES

Examples of the invention are described with reference to accompanying FIGS. 1 to 6 which are micrographic sections through chemical deposits obtained by implementing the invention.

DETAILED DESCRIPTION OF THE EXAMPLES

EXAMPLES 1-3

These examples relate to preparing a mother solution suitable for providing a bath in accordance with the invention. They make use respectively of the hydroxide, the basic carbonate, and the oxalate of the metal to be deposited as an insoluble precursor of the metallic compound.

EXAMPLE 1

$M^{2+}$ is used to designate the metal cation where M=Ni and/or Co. The initiaI metaI salt is a pure salt for electro-deposition. The choice of anion (designated by A−) for association with the cation is not critical and is left to the person skilled in the art (fluoride, sulfate, etc.).

Begin with the following conventional operations:

Put the $MA_2$ into solution and treat it for one hour with potassium permanganate.

Treat the resulting solution with activated vegetable carbon for one hour and filter within the following hour.

This provides a cleaned and filtered soIution of $MA_2$ in conventional manner. Then:

Add excess sodium hydroxide relative to the stoichiometric quantity required for precipitating M hydroxide given by:

$$M^{2+} + 2\,OH^- \longrightarrow M(OH)_2 \downarrow$$

Recover the precipitate by filtering or settling.

After washing the precipitate, treat it with anhydrous ethylenediamine (symboIized by Ietters ED) using 10% more than the stoichiometric quantity:

$$M(OH)_2 + 3\,ED \rightarrow M(ED)_3^{2+} + 2\,OH^-$$

Adjust the pH or more than 11 by adding sodium hydroxide.

The mother solution is now ready.

ExampIe 2

The starting salt is the basic carbonate of M as is commonly used for correcting the pH of electrolytic baths of nickel and/or cobalt sulfamate. The advantage of using such a salt lies in its intrinsic purity due to the way it is made. It is directly treated with anhydrous ethylenediamine using 10% more ED than the stoichiometric quantity necessary, so that the following reaction takes place:

$$MCO_3,\ M(OH)_2 + 6\,ED \rightarrow 2\,M(ED)_3^{2+} + 2\,OH^- + CO_3^{2-}$$

The resulting solution is diluted to one-half.

Most of the carbonate ions present in the solution are then eliminated by adding excess barium hydroxide relative to the stoichiometric quantity necessary according to the reaction:

$$Ba(OH)_2 + CO_3^{2-} \longrightarrow BaCO_3 \downarrow + 2\,OH^-$$

After filtering and adjusting the pH to greater than 11 using sodium hydroxide, the mother solution is ready.

Example 3

As in example 1, the anion of the initial salt is not critical. The solution of $MA_2$ is prepared in the same manner. A large excess of oxalic acid is added to this solution, thereby causing M oxalate to be precipitated according to the following reaction:

$$MA_2 + H_2C_2O_4 \longrightarrow MC_2O_4 \downarrow + 2\,HA$$

After washing, the precipitate is treated with anhydrous ethylenediamine using 10% more than the stoichiometric quantity necessary for the reaction:

$$MC_2O_4 + 3\,ED \rightarrow M(ED)_3^{2+} + C_2O_4^{2-}$$

After dilution to one-half, the solution is alkalinized using excess sodium hydroxide in order to obtain the desired compound by the following reaction:

$$M(ED)_3^{2+} + C_2O_4^{2-} + 2\,NaOH \longrightarrow M(ED)_3^{2+} + 2\,OH^- + Na_2C_2O_4 \downarrow$$

After filtering and adjusting the pH to greater than 11 using sodium hydroxide, the mother solution is ready. This method is simpler to implement and cheaper than the previous two methods.

EXAMPLES 4–10

These examples provide for depositing nickel and/or cobalt from the mother solutions prepared according to any one of Examples 1 to 3.

Example 4

This is a bath for depositing nickel and containing imidazole as the stabilizing agent.

It is made up as follows:

metal compound: nickel-II-tri(ethylenediamine) hydroxide $Ni(H_2N—CH_2—CH_2—NH_2)_3(OH)_2$: 0.14 mol.$l^{-1}$ pH agent: sodium hydroxide NaOH: 0.5 mol.$l^{-1}$ stabilizing agents: primary agent: imidazole $C_3H_4N_2$: 0.3 mol.$l^{-1}$ secondary agent: arsenic pentoxide $As_2O_5$: $6.5\times10^{-4}$ mol.$l^{-1}$ reducing agent: hydrated hydrazine $N_2H_4,H_2O$: 2.06 mol.$l^{-1}$ The temperature of the bath is maintained between 88° C. and 90° C. The speed of deposit then lies in the range 10 $\mu m.h^{-1}$ and 15 $\mu m.h^{-1}$.

FIG. 1 is a photograph of a deposit obtained on a brass substrate and magnified 500 times. The deposit obtained of pure nickel is pale gray, is of uniform thickness,.and has a Knoop hardness of about 450 HK under a load of 50 grams (g).

Example 5

Prepare a nickel deposit bath including thallium sulfate as its stabilizing agent, and having the following composition:

metal compound: nickel -II-tri(ethylenediamine) hydroxide $Ni(H_2N—CH_2—CH_2—NH_2)_3(OH)_2$:0.14 mol.$l^{-1}$ pH agent: sodium hYdrcxide NaOH: 0.5 mol.$l^{-1}$ stabilizing agents: primary agent: thallium sulfate $Tl_2SO_4$: $1.6.10^{-4}$ mol.$l^{-1}$ secondary agent: arsenic pentoxide $As_2O_5$: $6.5\times10^{-4}$ mol.$l^{-1}$ reducing agent: hydrated hydrazine $N_2H_4,H_2O$: 2.06 mol.$l^{-1}$ The temperature is maintained in the range 88° C. to 92° C.

The deposition reaction starts spontaneously even on copper alloy substrates. The weight gain is about 115 mg.$cm^{-2}.h^{-1}$, which corresponds to a speed of deposit growth of about 130 $\mu m.h^{-1}$.

This solution is of remarkable stability and its lifetime appears to be unlimited. For example, a one-liter bath which initially contains the equivalent of 8.2 g of metallic nickel has been used to deposit 28.4 g of metallic nickel. The initial concentration was thus renewed 3.5 times, and the bath continued to function satisfactorily.

The deposit obtained is black and does not reflect light. Metallographic observations of a section through said deposit shows that it is porous (see FIG. 2 which is a photograph at a magnification of 100 diameters showing a deposit obtained on a brass substrate.

The hardness measured on the raw deposit from the bath was about 400 HK (or about 400 HV on the Vickers scale) under a load of 50 g.

Analysis of the occluded gas gives 9 ppm of hydrogen, 542 ppm nitrogen and 429 ppm oxygen.

This bath contains thallium ions, as do the baths of some of the following examples, and therefore it leaves traces of thallium in the deposit. As explained in the abova-mentioned French patent specification No. 2 531 103, such thallium baths are not suitable for the abovementioned aeronautical applications. However, they may be of considerable interest in other applications by virtue of their long life, and the uniformity, the thickness, and the physical and mechanical characteristics of the deposits they can be used to obtain, together with the possibility of including uniformly distributed particles is said deposits.

Example 6

A bath is prepared including thallium sulfate as its stabilizing agent. This bath differs from the preceding bath in that the nickel-II-tri(ethylenediamine) hydroxide is replaced by an equivalent quantity of cobalt-II-tri(ethylenediamine) hydroxide, and in that 1.7 mol.$l^{-1}$ ethylenediamine is added.

The temperature of the bath is maintained in the range 78° C. to 82° C. The speed of deposit lies in the range 55 $\mu m.h^{-1}$ to 30 $\mu m.h^{-1}$.

The photograph of FIG. 3 is at a magnification of 500 diameters and shows the resulting deposit of cobalt on a brass substrate. This deposit is semi-bright, dense and uniform, and has a hardness of about 350 HK under a load of 50 g.

Free ethylenediamine must be inserted into this bath in order to maintain the cobalt ions in solution since they have less affinity for ethylenediamine than nickel ions.

Example 7

This example illustrates a nickel deposit bath containing particles of alumina.

The composition of the bath is as follows:

metal compound: nickel-II-tri(ethylenediamine) hydroxide $Ni(H_2N—CH_2—CH_2—NH_2)_3(OH)_2$: 0.14 mol.$l^{-1}$ pH agent: sodium hydroxide NaOH: 0.5 mol.$l^{-1}$ stabilizing agents: primary agent: imidazole $C_3H_4N_2$: 0.3 mol.$l^{-1}$ secondary agent: arsenic pentoxide $As_2O_5$: $6.5\times10^{-4}$ mol.$l^{-1}$ reducing agent: hydrated hydrazine $N_2H_4,H_2O$: 2.06 mol.$l^{-1}$ particle fill: alumina $A;_2O_3$ (average diameter=0.6 $\mu m$): 25 g.$l^{-1}$ The temperature is maintained in the range 88° C. to 92° C. The speed of deposit is about 35 $\mu m.h^{-1}$.

The color of the deposit is black. An examination of a metallographic section shows particles of alumina included in the nickel deposit (see FIG. 4 which is a photograph at a magnification of 700 diameters of a deposit obtained on a brass substrate, with the alumina being added after depositing for 20 minutes). The hardness of this deposit is about 400 HV under a load of 50 g, i.e. it is comparable with the hardness obtained for an alumina free deposit. As in Example 5, the deposit is porous.

Example 8

A nickel deposit bath is prepared using lead acetate as the stabilizing agent and having the following composition:

metal compound: nickel-II-tri(ethylenediamine) hydroxide $Ni(H_2N—CH_2—CH_2—NH_2)_3(OH)_2$: 0.14 mol.$l^{-1}$ pH agent: sodium hydroxide NaOH: 0.5 mol.$l^{-1}$ stabilizing agents: primary agent: lead acetate $Pb(O_2CCH_3)_2,3H_2O$: $3,2.10^{-4}$ mol.$l^{-1}$ secondary agent: arsenic pentoxide $As_2O_5$: $6.5\times10^{-4}$ mol.$l^{-1}$ reducing agent: hydrated hydrazine $N_2H_4,H_2O$: 2.06 mol.$l^{-1}$ The temperature is maintained in the range 88° C. to 92° C. The deposition reaction starts spontaneously, even on copper alloy substrates.

The speed of deposit is about 20 $\mu m.h^{-1}$.

The deposit is dense and unifo gray in color (of FIG. 5 which is a photograph at a magnification of 750 diameters of two successive deposits obtained on a brass substrate, without any surface preparation being performed therebetween).

Example 9

Twenty grams per liter of yttria particles having a granulometry in the range 0.5 microns to 1.5 microns are added to the bath of Exampie 8.

The temperature is maintained in the range 88° C. to 92° C. and the bath is stirred by means of a stirrer rotating at about 800 revolutions per minute.

The speed of deposition is 10 $\mu m.h^{-1}$ to 15 $\mu m.h^{-1}$.

The deposit obtained is dark gray, dense and uniform: metallographic examination shows particles of yttria included in a nickel matrix (see FIG. 6 which is a photograph at a magnification of 950 diameters of a deposit obtained on a mild steel substrate).

Example 10

A nickel-cobalt bath has the following composition:

metal compound:

Nickel-II-tri(ethylenediamine) hydroxide: 0.14 mol.$l^{-1}$

Cobalt-II-tri(ethylenediamine) hydroxide: $7\times10^{-3}$ mol.$l^{-1}$ complexing agent: ethylenediamine: $3\times10^{-3}$ mol.$l^{-1}$ pH agent: sodium hydroxide NaOH: 0.5 mol.$l^{-1}$ stabilizing agents: primary agent: lead acetate: 0.5 mol.$l^{-1}$ secondary agent: arsenic pentoxide $As_2O_5$: $6.5\times10^{-4}$ mol.$l^{-1}$ reducing agent: hydrated hydrazine $N_2H_4,H_2O$: 2.06 mol.$l^{-1}$ The temperature is maintained in the range 78° C. to 82° C.

The speed of deposit is 18.1 $\mu m.^{-1}$.

This bath has provided a 13.2 $\mu m$ thick deposit of a nickel-cobalt alloy as shown by qualitative analysis using energy dispersive spectroscopy and a scanning eleotron microscope.

The occluded gas content of the various deposits obtained is relatively low, thereby giving rise to little tension in the metal layers. Thus the quantities of oxygen, nitrogen and hydrogen in the deposit of Example 6 are respectively 429 ppm, 542 ppm, and 9 ppm, which is substantially less than the minimum values mentioned in the above-specified article by Dini and Coronado, namely 900 ppm, 2410 ppm, and 150 ppm.

Semi-bright deposits of cobalt and/or nickel can also be obtained. The speed at which nickel is deposited (which is about 15 $\mu m.h^{-1}$ for dense deposits) may be increased by adding thallium. Speeds of deposit of 130 $\mu m.h^{-1}$ have been obtained in this way. In this case the deposit is porous and black.

The residual stress in such deposits is also low, thereby making it possible to obtain thick deposits. Thus, a deposit has been obtained in the laboratory which is about 1 mm thick.

We claim:

1. In an alkaline bath for chemically depositing a metal selected from the group consisting of nickel, cobalt, and mixtures thereof by autocatalytic reduction of a salt of the metal, and which comprises a salt of nickel, cobalt, or mixtures thereof in an aqueous solution at a pH greater than 11, a stabilizing agent, and hydrazine as a reducing agent, the improvement which comprises:

providing the nickel, cobalt, or mixtures thereof in the form of an aqueous alkaline mother solution of $$M(H_2NCH_2CH_2NH_2)_3(OH)_2$$

wherein M is nickel, cobalt, or-a mixture of nickel and cobalt, by reaction of an insoluble salt of the metal M with a stoichiometric excess of ethylene diamine, and wherein hydroxyl ions are the exclusive anions present in the bath

2. The improvement defined in claim 1 wherein $M(H_2NCH_2CH_2NH_2)_3(OH)_2$ in the alkaline bath is $Ni(H_2NCH_2CH_2NH_2)_3(OH)_2$ present in a concentration of 0.14 moles/liter.

3. The improvement defined in claim 1 wherein the $(H_2NCH_2CH_2NH_2)_3(OH)_2$ in the alkaline bath is $Co(H_2NCH_2CH_2NH_2)_3(OH)_2$ present in a concentration of 0.14 moles/liter

4. The improvement defined in claim 1 wherein the $M(H_2NCH_2CH_2NH_2)_3(OH)_2$ in the alkaline bath is a mixture of $Ni(H_2NCH_2CH_2NH_2)_3(OH)_2$ present in a concentration of 0.14 moles/ and $Co(H_2NCH2CH_2NH_2)_3(OH)_2$ present in a concentration of 0.007 moles/liter.

5. The improvement defined in claim I wherein the bath contains imidazole as a stabilizing agent.

6. The improvement defined in claim 1 wherein the bath contains a thallium salt as a stabilizing agent.

7. The improvement defined in claim 6, wherein the thallium salt is thallium sulfate.

8. The improvement defined in claim 1 wherein the bath contains a lead salt as a stabilizing agent.

9. The improvement defined in claim 8, wherein the lead saltis lead acetate.

10. The improvement defined in claim 1 wherein the bath contains arsenic pentoxide as a stabilizing agent.

11. The improvement defined in claim 1 wherein the bath contains particles of alumina.

12. The improvement defined in claim 1 wherein the bath contains particles of yttria.

13. An aqueous alkaline mother solution for chemically depositing a metal selected from the group consisting of nickel, cobalt and mixtures thereof by autocatalytic reduction of a salt of the metal which comprises:

$$M(H_2NCH_2CH_2NH_2)_3(OH)_2$$

where M is nickel, cobalt, or a mixture of nickel and cobalt, at a pH greater than 11, wherein hydroxyl ions are the exclusive anions present, by reaction of an insoluble salt of the metal M with an excess of ethylene diamine.

* * * * *